United States Patent [19]

Yashiki et al.

[11] Patent Number: 4,883,034

[45] Date of Patent: Nov. 28, 1989

[54] ENGINE IDLING SPEED CONTROL SYSTEM

[75] Inventors: Seiji Yashiki, Hiroshima; Hiroshi Hirano, Hatsukaichi; Kazutomo Sasaki, Hiroshima, all of Japan

[73] Assignee: Mazda Motor Corporation, Hiroshima, Japan

[21] Appl. No.: 226,024

[22] Filed: Jul. 29, 1988

[30] Foreign Application Priority Data

Jul. 31, 1987 [JP] Japan ..... 62-192438

[51] Int. Cl.[4] ..... F02D 9/02; F02D 41/16

[52] U.S. Cl. ..... 123/339; 364/431.07; 364/431.12

[58] Field of Search ..... 123/339, 486, 585; 364/431.07, 431.12

[56] References Cited

U.S. PATENT DOCUMENTS

| | | | |
|---|---|---|---|
| 4,457,275 | 7/1984 | Hosokai et al. | 123/339 |
| 4,457,276 | 7/1984 | Ueda et al. | 123/339 |
| 4,474,153 | 10/1984 | Hanamoto et al. | 123/339 |
| 4,488,525 | 12/1984 | Tsutsumi et al. | 123/352 |
| 4,508,076 | 4/1985 | Oda et al. | 123/339 |
| 4,562,808 | 1/1986 | Tominaga et al. | 123/339 |
| 4,625,697 | 12/1986 | Hosaka | 123/339 |
| 4,676,211 | 6/1987 | Kiuchi et al. | 123/339 |
| 4,682,044 | 7/1987 | Hotate et al. | 290/40 B |
| 4,691,675 | 9/1987 | Iwaki | 123/339 |
| 4,697,562 | 10/1987 | Boccadoro et al. | 123/339 |
| 4,700,675 | 10/1987 | Otobe et al. | 123/339 |
| 4,716,871 | 1/1988 | Sakamoto et al. | 123/339 |
| 4,729,359 | 3/1988 | Tomisawa et al. | 123/339 X |
| 4,747,379 | 5/1988 | Oba | 123/339 |

FOREIGN PATENT DOCUMENTS 0098413 8/1979 Japan .

*Primary Examiner*—Willis R. Wolfe

*Attorney, Agent, or Firm*—Fleit, Jacobson, Cohn, Price, Holman & Stern

[57] ABSTRACT

A system for controlling idling speed of an internal combustion engine in which a speed sensor senses rotational speed of the engine. A determinator is provided for determining whether the engine is in an idling state. An output adjustor adjusts engine output when the engine is determined to be in the idling state by the determinator. A memory stores a control variable of the output adjustor in the form of a characteristic in which engine output rises approximately in proportion to a difference between a predetermined target idling speed and an actual idling speed with engine speed serving as a parameter. A control acts responsive to outputs from the determinator and the speed sensor for obtaining from the memory a control variable corresponding to engine speed at idling, and for controlling the output adjustor on the basis of the control variable. A load detector detects whether an external load is connected with the engine in operational relation; and a control variable characteristic changer changes characteristic of the control variable from the memory responsive to output from the load detector.

11 Claims, 9 Drawing Sheets

ENGINE IDLING SPEED CONTROL SYSTEM

FIELD OF THE INVENTION

This invention relates to an engine idling speed control system for an internal combustion engine, and more particularly to a feedback control system for controlling engine idling speed in a vehicle.

BACKGROUND OF THE INVENTION

Feedback control systems for controlling engine idling speed, which control intake air amount or ignition timing according to a signal based on a difference between a predetermined target idling speed and an actual idling speed, are well known. For example, Japanese Patent Application laid open No. 54-98413 shows such a system. This system includes a feedback control mechanism and a load switch for detecting a load change under idling condition. When the load switch detects increasing load, the system increases a normally constant intake air amount by enlarging the opening area of a by-pass air passage provided in the intake passage during a predetermined time to prevent a decrease in the actual engine speed due to the load.

Such a system which compensates a normally constant intake air amount according to a load change is unable generally to keep a proper engine idling speed for various engine operations conditions. For example, an engine connected with the automatic transmission experiences two different load conditions. One load condition is that the transmission is in a driving range, and another load condition is that the transmission is in a non-driving range, such as a neutral or parking range. When the automatic transmission is in the driving range, the friction load of a gear train of the transmission makes the engine idling speed stable.

On the other hand, when the automatic transmission is in the non-driving range, the engine idling speed is unstable compared with the condition when the automatic transmission is in the driving range because the friction load of the gear train is removed.

SUMMARY OF THE INVENTION

Accordingly, an object of the present invention is to provide a stable idling speed control system for an engine for a vehicle which is connected with an external load, such as, an automatic transmission, an air conditioner or a generator. Another object of the present invention is to provide an engine idling speed control system for a vehicle which is able to keep a stable idling speed even if or when an external load condition is changed.

In order to accomplish the above-mentioned objects of the present invention, an engine idling speed control system is provided by the present invention which comprises an engine speed sensor for sensing an actual engine speed and sending an engine speed signal, idling condition determination means for determining whether the engine is in an idling condition and sending an idling condition signal, engine output adjusting means for adjusting an engine output, memory means for storing a control variable of the engine output adjusting means by which the engine output is controlled approximately in proportion to a difference between a predetermined target idling speed and the engine speed signal, control means for obtaining the control variable from the memory means according to the difference and the idling condition signal and controlling the engine output adjusting means by the control variable, external load detecting means for detecting whether the engine is connected with an external load and sending an external load signal, and control variable changing means for changing the control variable according to the external load signal. Accordingly, the idling speed control system of the invention exhibits a quick response and excellent stability for external loads.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
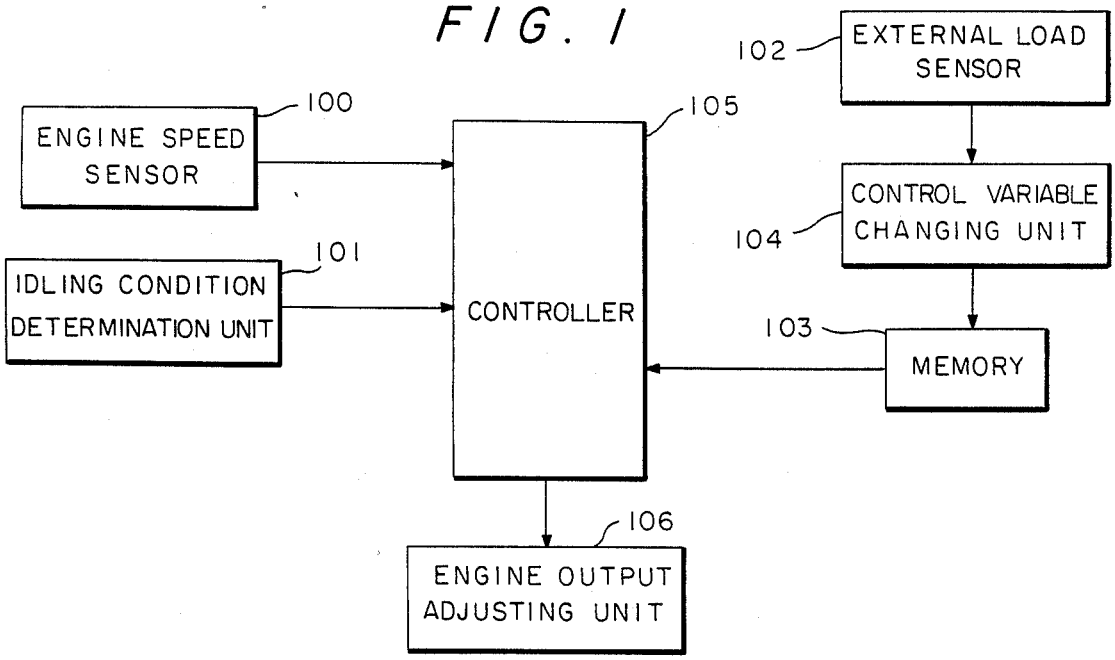
FIG. 1 is a schematic block diagram of an engine idling speed control system according to the present invention.

Referring now to FIG. 1 shown therein in a block diagram of the principal construction of the engine idling speed control system in accordance with the present invention. In FIG. 1, the engine idling speed control system comprises an engine speed sensor 100 for sensing an actual engine speed, an idling condition determination unit 101 for determining whether the engine is in an idling condition, an external load sensor 102 for sensing whether the engine is connected with an external load, a memory 103 for storing engine speed control variables corresponding to the engine speed when the determination unit 101 determines that the engine is in the idling condition, a control variable changing unit 104 for changing a feedback control characteristic in accordance with the load condition sensed by the external load sensor 102, a controller 105 which reads the engine control variable including the feedback control characteristics from the memory 103 when the determination unit 101 determines that the engine is in the idling condition in accordance with the engine speed sensed by the speed sensor 100 and the output from the control variable changing unit 104, and an engine output adjusting unit 106 for adjusting an engine output which is controlled by the controller 105.

Figure 2:
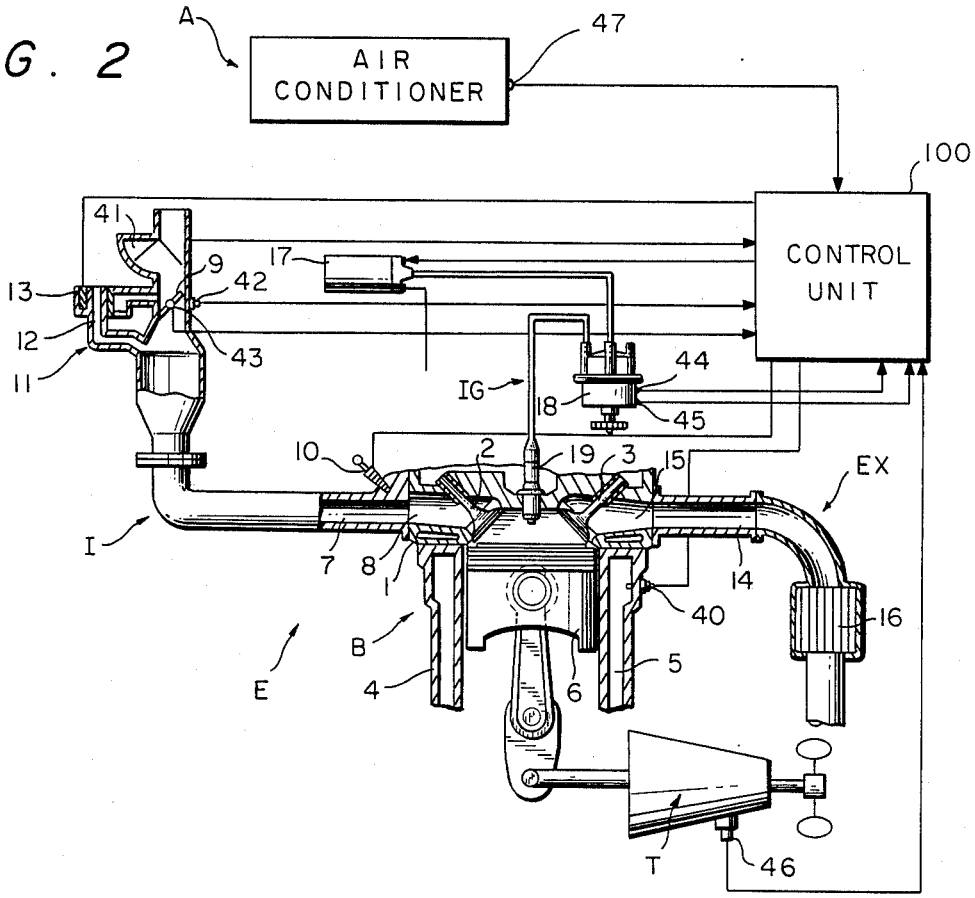
FIG. 2 is a schematic illustration of an embodiment of an engine idling speed control system according to the present invention.

In FIG. 2, an engine E, incorporated in a vehicle, is composed of an engine body B, an intake device I, an exhaust device EX and an ignition device IG. The engine body B is composed of a cylinder head 1 which provides an intake valve 2 and an exhaust valve 3, a cylinder 4 surrounded by a cooling water passage 5, and a piston 6 which slides on the inner surface of the cylinder 4. A known water temperature sensor 40 is attached to the cylinder 4 for detecting the temperature of the cooling water in passage 5.

The intake device I is composed of an intake passage 7 which is connected with an intake port 8 of the cylinder head 1, a throttle valve 9, a fuel injector 10, and an idling speed control device 11. The idling control device 11 is composed of a bypass passage 12 which bypasses the throttle valve 9 and a known idling speed control actuator 13 which controls an intake air amount in an idling condition. A known air flow sensor 41 is provided in the intake passage 7 at the upper side of the throttle valve 9 for sensing the intake air flow rate, and a known idle switch 42 and a known throttle opening sensor 43 are provided to the intake device I. The idle switch 42 turns on when the throttle valve 9 is in the fully closed position for detecting that the engine E is in the idling condition. The throttle opening sensor 43 detects the degree of opening of the throttle valve 9 continuously.

The exhaust device EX is composed of an exhaust passage 14 which is connected with an exhaust port 15 of the cylinder head 1, and a catalyst converter 16. The ignition device IG is composed of an igniter 17, a distributor 18 and an ignition plug 19. A known engine speed sensor 44 which senses engine speed and a known crank angle sensor 45 which senses crank angle of the engine E are provided in the distributor 18. A known automatic transmission T which is able to be selected to a non-driving (n) range such as P or N range and a driving (D) range such as 1, 2, D or R range is connected with the engine E. A known D range switch 46 is provided to the automatic transmission T, and turns on when the automatic transmission T is in the D range for detecting that the vehicle is in a driving condition.

A known air conditioner switch 47 is provided to an air conditioner A, and turns on when the air conditioner A is in an operation condition for detecting that an external load is loaded to the engine E.

Signals from the water temperature sensor 40, the air flow sensor 41, the idle switch 42, the throttle opening sensor 43, the engine speed sensor 44, the crank angle sensor 45, the D range switch 46 and the air conditioner switch 47 are sent to a control unit 100. Control unit 100 controls fuel injection timing of the fuel injector 10, and ignition timing of the ignition device IG and the idle speed control actuator 13. Controls of the fuel injection timing of the fuel injector 10 and the ignition timing of the ignition device IG are able to be executed by well known controls and for simplicity the description of the controls is omitted in this description.

Figure 3:
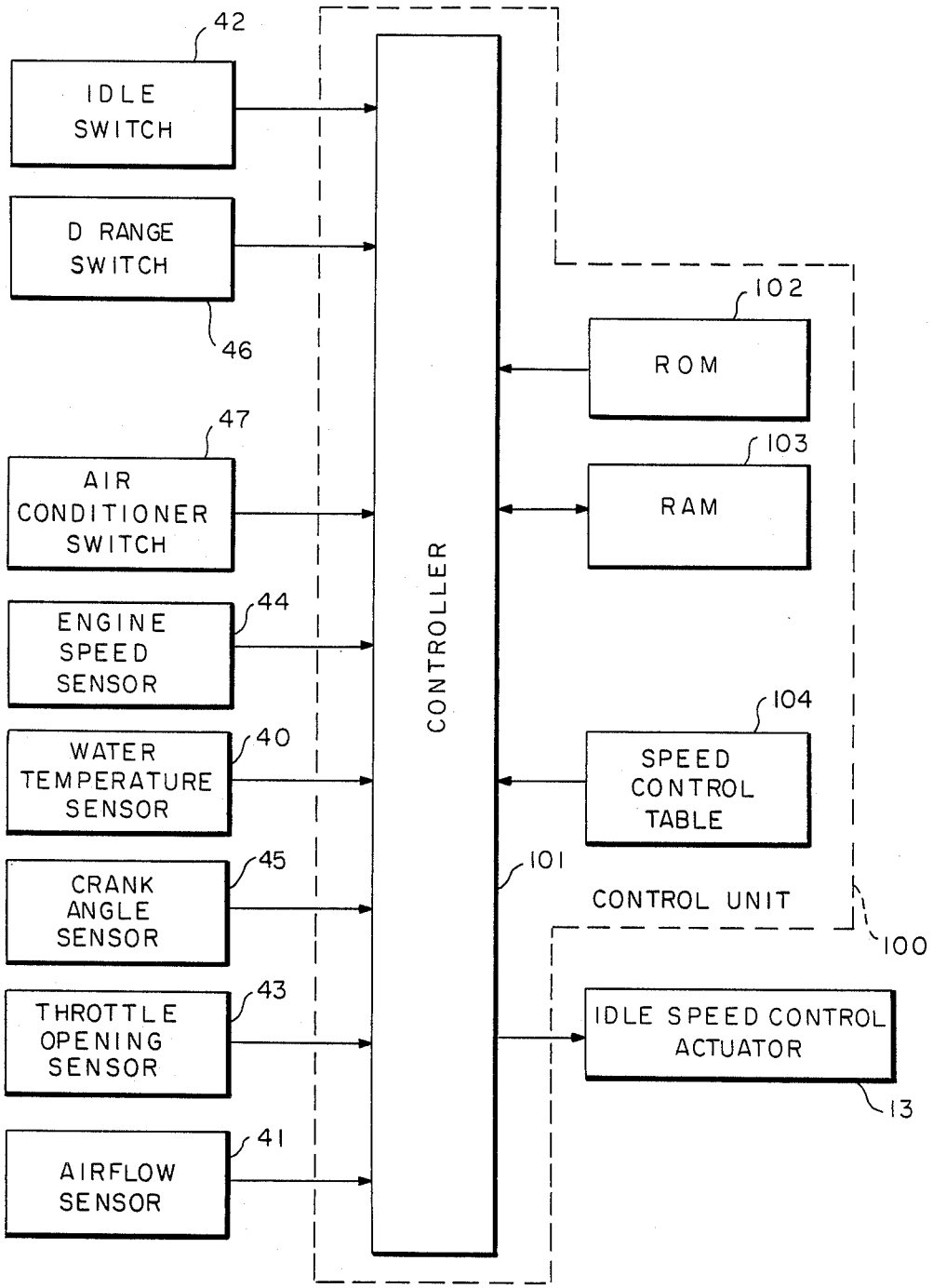
FIG. 3 illustrates a block diagram of a portion of the embodiment shown in FIG. 2.

As shown in FIG. 3, the control unit 100 is composed of a controller 101, a ROM 102, a RAM 103, and a speed control table 104. The controller 101 executes the control of the idling speed control actuator 13 in accordance with a program stored in the ROM 102. The RAM 103 stores various flags, control data and the like temporarily. The speed control table 104 stores idling speed control data which will be described in detail hereinafter.

Figure 4:
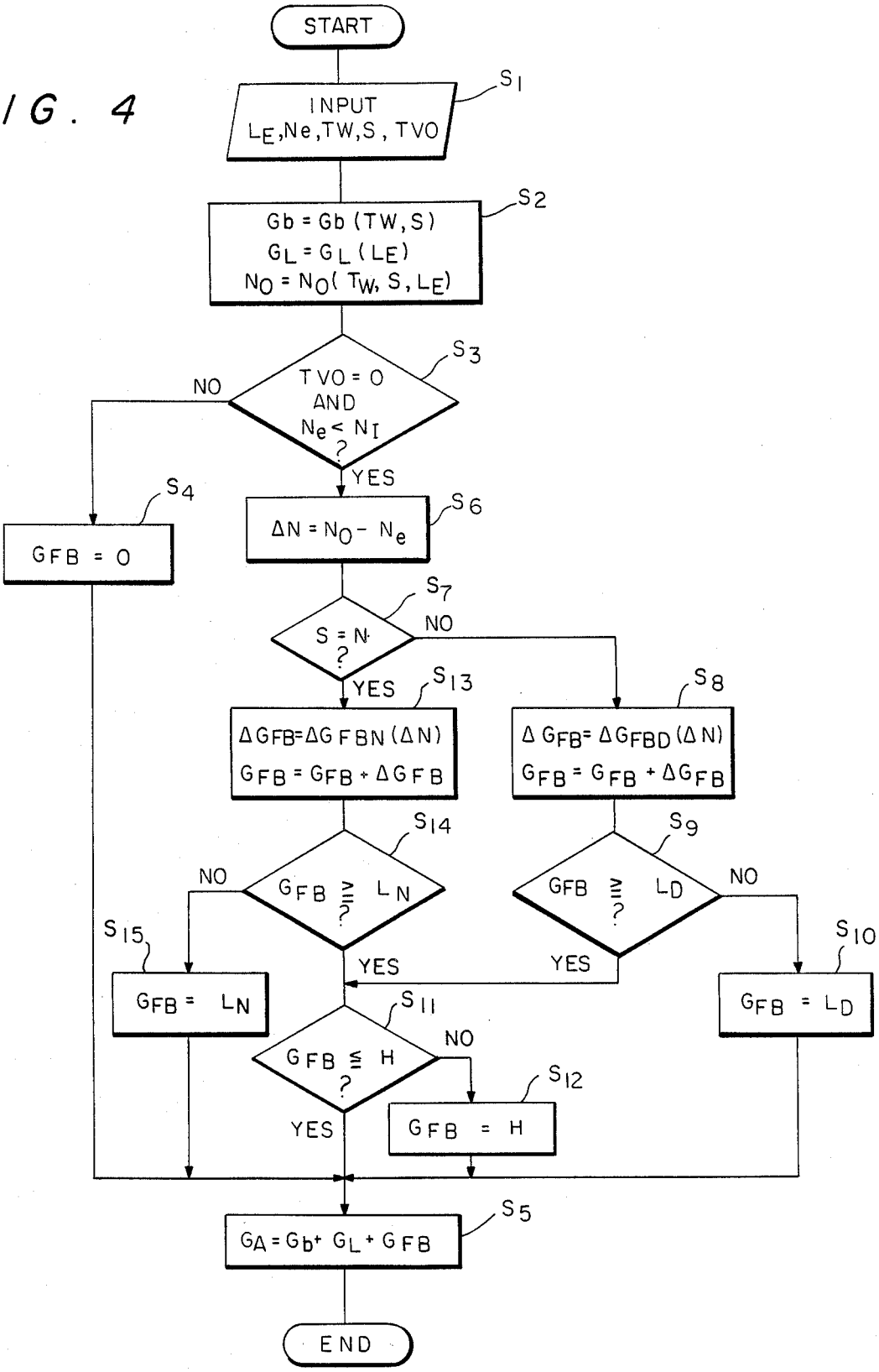
FIG. 4 is a flowchart illustrating engine intake air amount control according to the present embodiment.

The idling speed control by the controller 101 of the control unit 100 will be performed by a flowchart as depicted in FIG. 4. The idling speed control is based on control of an intake air amount which is supplied into the engine body B. The intake air amount control is carried out by means of controlling a bypass air amount of the bypass passage 12 by the idling speed control actuator 13.

The control shown in FIG. 4 starts at predetermined time intervals (e.g. 0.07 sec). In step S1, air conditioner operation condition $L_E$, actual engine speed Ne, cooling water temperature TW, automatic transmission range condition S and throttle opening condition TVO are read from the air conditioner switch 47, the engine speed sensor 44, the water temperature sensor 40, the D range switch 46 and the idle switch 42, respectively.

Figure 5:
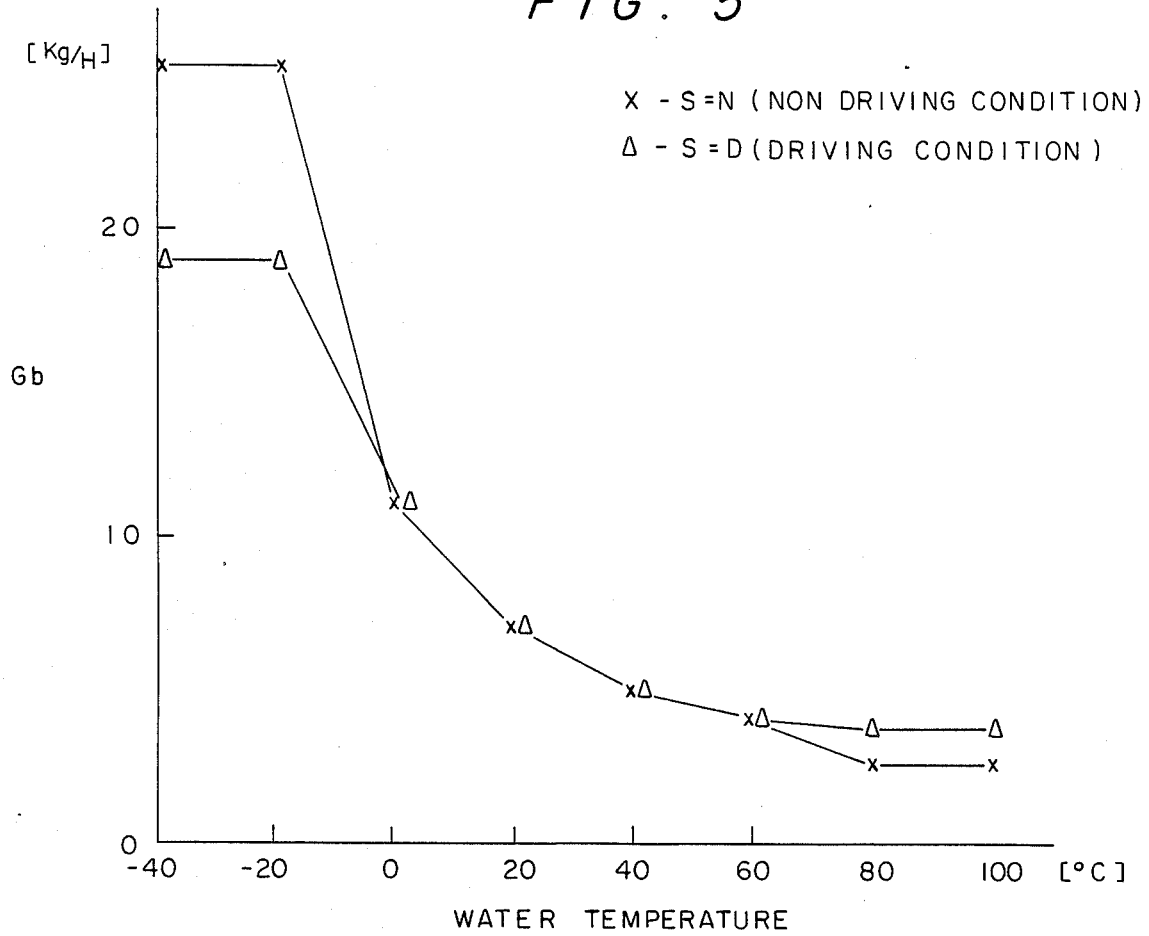
FIG. 5 is a diagram illustrating the relationship between a basic intake air amount and cooling water temperature.
Figure 6:
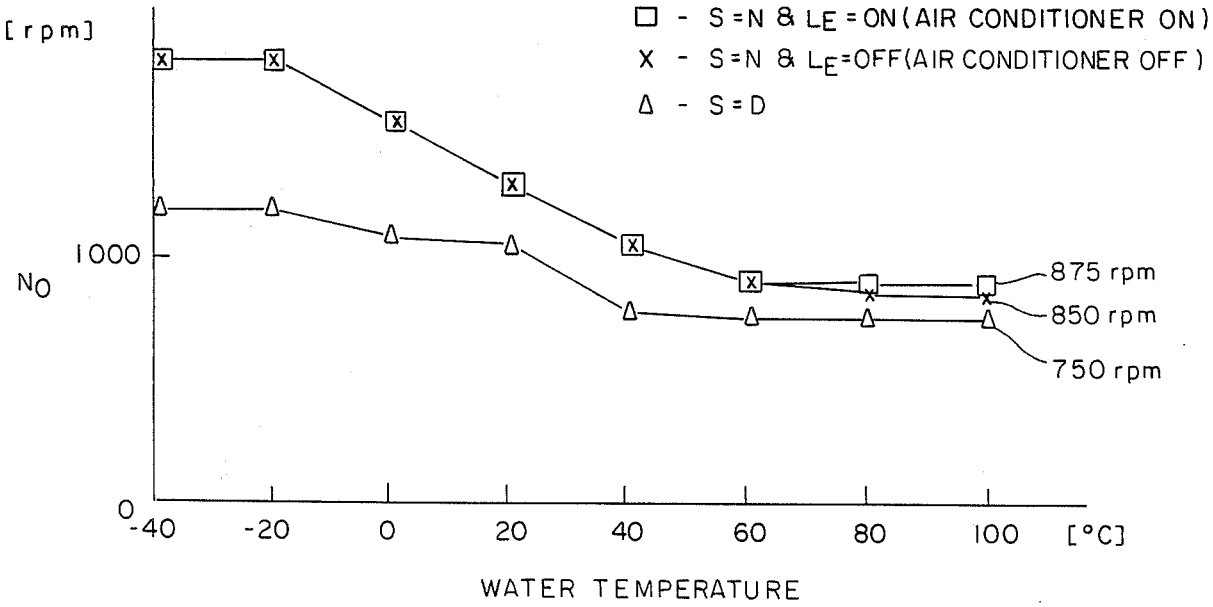
FIG. 6 is a diagram illustrating the relationship between a target idling speed and cooling water temperature.

In step S2, a basic air amount $G_b$, an additional air amount $G_L$ which is added while the air conditioner switch 47 is detecting the operating condition of the air conditioner A, and a target idling speed No is read from the idle speed control table 104 according to date read at step 1. The basic air amount $G_b$ and the target idling speed No are determined by maps shown in FIG. 5 and FIG. 6, respectively. And, the additional air amount $G_L$ is set at 5 kg/H when the air conditioner A is in the operation condition and is et at 0 kg/H when the air conditioner is in the non-operation condition.

Step S3 determines whether the throttle valve 9 is in a fully closed condition according to the data TVO which was read in step S1 and the actual engine speed Ne which was read in step S1 is less than a predetermined speed $N_I$. The predetermined speed $N_I$ is determined by adding a predetermined value (e.g. 170 r.p.m.)

to the target idling speed No. In other words, step S3 determines whether the engine E is in the idling condition. If the engine E is not in the idling condition, the program proceeds to step S4.

In step S4, a feedback control air amount $G_{FB}$ is set at zero.

In step S5, a total control air amount GA which determines a control value of the idling speed control actuator 13 so as to set intake air through the bypass passage 12 is calculated by adding $G_b$, $G_L$, and $G_{FB}$. In this condition, $G_A=G_b+5$ when the air conditioner A is in the operation condition, and $G_A=G_v$ when the air conditioner A is in the non-operation condition.

In step S3, if the engine E is in the idling condition, the program proceeds to step S6. In step S6, a speed difference N between the target idling speed No and the actual engine speed Ne is calculated. And, in step S7, the automatic transmission range condition S is checked.

If the automatic transmission range condition S read in step 1 indicates the D range, the program proceeds to step S8. In step S8, an additional feedback control air amount $\Delta G_{FB}$ is determined according to a characteristic line $\Delta G_{FBD}$ shown in FIG. 7 stored in the speed control table 104. And, the feedback control air amount $G_{FB}$ is revised by adding $G_{FB}$ to the previous value of the feedback control air amount $G_{FB}$.

Figure 7:
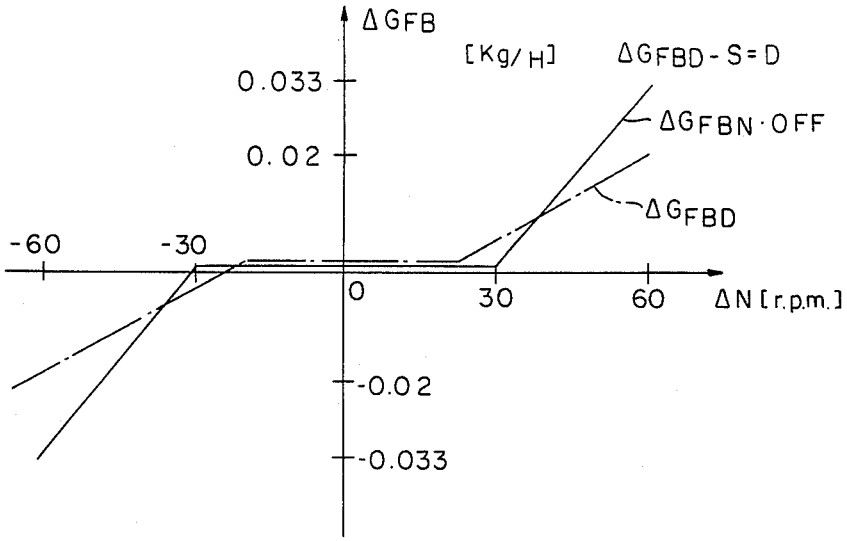
FIG. 7 is a diagram illustrating the relationship between an additional control variable adding to an actual intake air amount, and a difference between an actual engine speed and a target idling speed when an automatic transmission is in a driving range and in a non-driving range.

In, step S9, a lower limit $L_D$ which guarantees the lowest value of the feedback control air amount $G_{FB}$ is determined according to a characteristic line shown in FIG. 7 stored in the speed control table 104, and the feedback control air amount $G_{FB}$ which was revised in step S8 is compared with the lower limit $L_D$. If the feedback control air amount $G_{FB}$ is less than the lower limit $L_D$, the program proceeds to step S10.

In step S10, the feedback control air amount $G_{FB}$ is set at the value of the lower limit $L_D$, and, the program proceeds to step S5 and the total control air amount $G_A$ is calculated. In this condition $G_A=G_b+5+L_D$ when the air conditioner A is in the operation condition and $G_A=G_b+L_D$ when the air conditioner A is in the non-operation condition. If the feedback control air amount $G_{FB}$ is equal to the lower limit $L_D$ or greater than the lower limit $L_D$, in step S9, the program proceeds to step S11.

Figure 9:
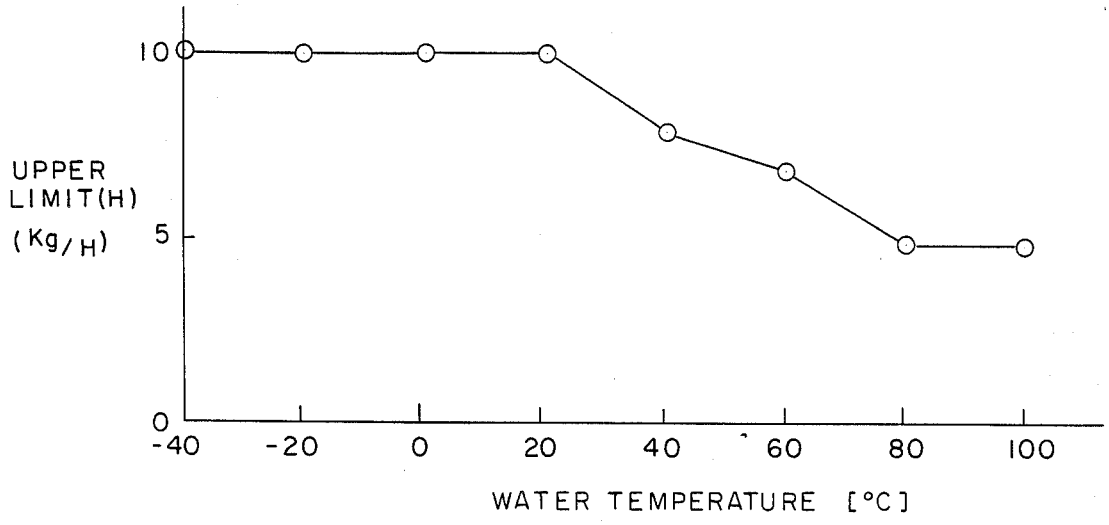
FIG. 9 is a diagram illustrating the relationship between an upper of a feedback control air amount and cooling water temperature.

In step S11, an upper limit H which restricts the highest value of the feedback control air amount $G_{FB}$ is determined according to a characteristic line shown in FIG. 9 stored in the speed control table 104, and the feedback control air amount $G_{FB}$ is compared with the upper limit H. If the feedback control air amount is greater than the upper limit H, the program proceeds to step S12. In step S12, the feedback control air amount is set at the value of the upper limit H, and, the program process to the step S5. In step S5 $G_A=G_b+5+H$ when the air conditioner A is in the operation condition and $G_A=G_b+H$ when the air conditioner A is in the non-operation condition. If the feedback control air amount $G_{FB}$ is equal to the upper limit H or smaller than the upper limit H in step 11, the program proceeds to step S4, and the feedback control air amount $G_{FB}$ which was obtained in step S8 is used for the calculation of the total control air amount $G_A$ directly.

If the automatic transmission range condition S indicates the N range in step S7, the program proceeds to step S13. In step S13, the additional feedback control air amount $\Delta G_{FB}$ is determined according to a characteristic line $\Delta G_{FBN.ON}$ or $\Delta G_{FBN.OFF}$ shown in FIG. 10 stored in the speed control table 104. The characteristic lines $\Delta G_{FBN.ON}$ and $\Delta G_{FBN.OFF}$ are used in the operation condition of the air conditioner and in the non-operation condition of the air conditioner, respectively. And, the feedback control air amount $G_{FB}$ is revised by adding $\Delta G_{FB}$ to a previous value of the feedback control air amount $G_{FB}$.

In step S14, a lower limit $L_N$ is determined according to a characteristic line shown in FIG. 7, and the feedback control air amount $G_{FB}$ which was revised in step S13 is compared with the lower limit $L_N$. If the feedback control air amount $G_{FB}$ is less than the lower limit $L_N$, the program proceeds to step 15.

In step 15, the feedback control air amount $G_{FB}$ is set at the value of the lower limit $L_N$. And, the program proceeds to step S5 and the total control air amount $G_A$ is calculated. In this condition, $G_A=G_b+5+L_N$ when the air conditioner A is in the operation condition, and $G_A=GB+L_N$ when the air conditioner A is in the non-operation condition. If the feedback control air amount $G_{FB}$ is equal to the lower limit $L_N$ or greater than the lower limit $L_N$, in step S14, the program proceeds to step S11. And, the program proceeds with the same steps which are described above.

Figure 10:
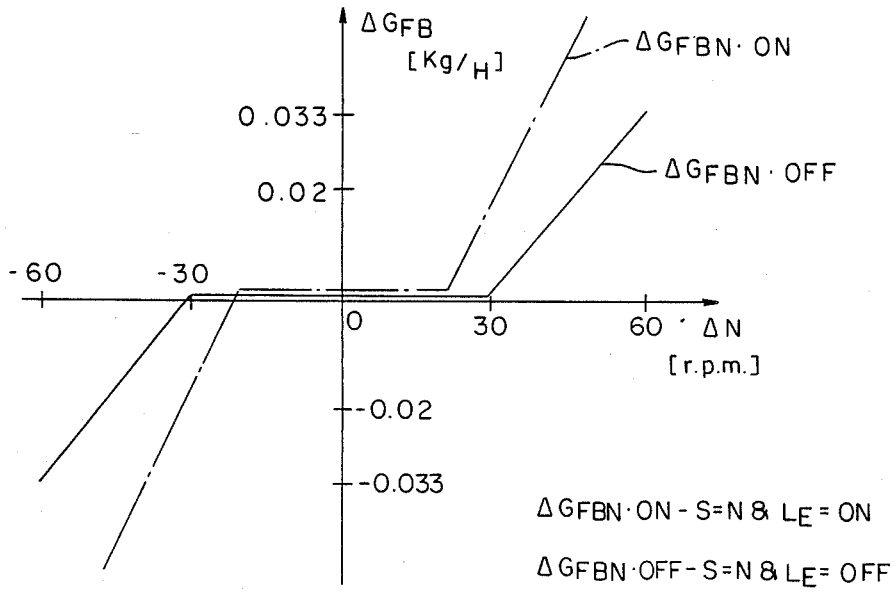
FIG. 10 is a diagram illustrating the relationship between an additional control variable adding to an actual intake air amount, and a difference between an actual engine speed and a target idling speed when an air conditioner is in an operation condition and in a non-operation condition.

As shown in FIG. 7 and FIG. 10, the additional feedback control air amount $\Delta G_{FB}$ is kept at zero in a predetermined range of the difference $\Delta N$. And, the predetermined range is set wider when the automatic transmission T is in the N range or when the air conditioner A is in the non-operation condition than when the automatic transmission T is in the D range or when the air conditioner A is in the operation condition. Therefore, it is able to control the engine idling speed properly, because the engine idling speed is unstable originally when external loads such as the automatic transmission or the air conditioner A is not loaded to the engine E.

Figure 8:
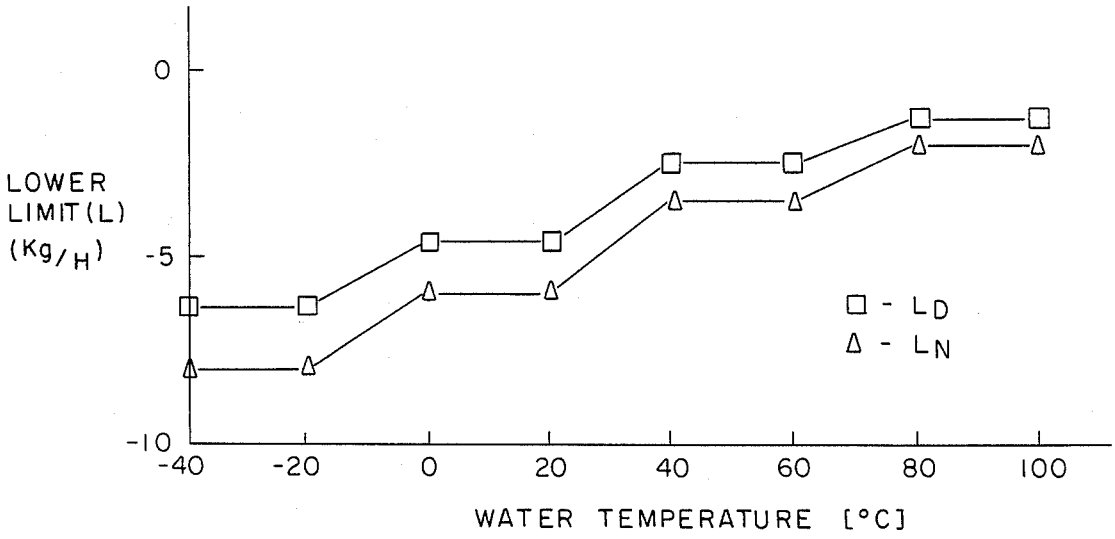
FIG. 8 is a diagram illustrating the relationship between a lower limit of a feedback control air amount and cooling water temperature.

As shown in FIG. 7, a rate of change of $\Delta G_{FD}$ to $\Delta N$ is set smaller than that of $\Delta G_{FBN.OFF}$ to $\Delta N$, because the engine idling speed changes slowly when the automatic transmission T is in the D range. And, as shown in FIG. 10, a rate of change of $G_{FBN.ON}$ to $\Delta N$ is set greater than that of $\Delta G_{FBN.OFF}$ to $\Delta N$, because internal resistance of the engine E becomes great when the engine speed changes for the reason that the target idling speed No is set high when the air conditioner A is in the operation condition. As shown in FIG. 8, the lower limit in the D range is set higher than that in the N range so that engine stall in the D range is prevented when the automobile is driven with the throttle valve 9 in the fully closed condition, and fuel consumption in the N range is improved by expanding the control range of $G_{FB}$.

Figure 11:
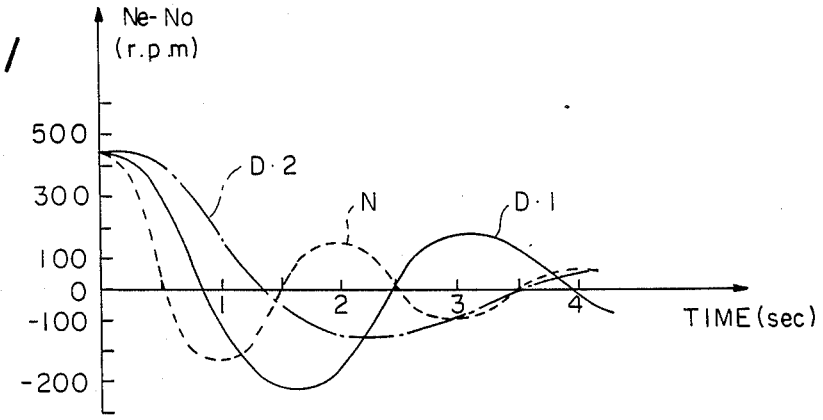
FIG. 11 is a graph illustrating the relationship between actual rotational speed and time, while an automatic transmission is selected to a drive range according to the present embodiment.
Figure 12:
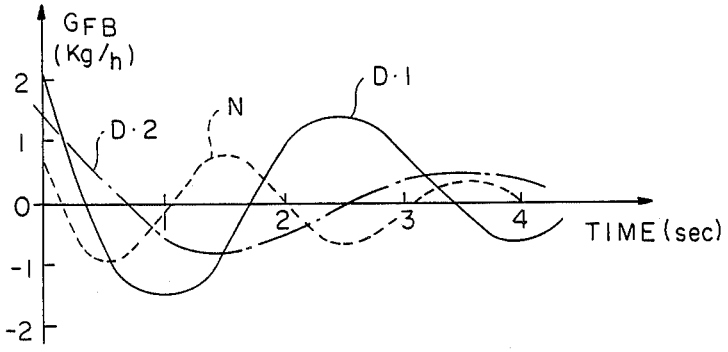
FIG. 12 is a graph illustrating the relationship between an actual additional intake air amount and the time which is the same as that in FIG. 11 according to the embodiment.

Shown in FIGS. 11, 12, 13, 14, 15 and 16 are examples of time charts illustrating the changes of Ne-No and the feedback control intake air amount $G_{FB}$ according to abovementioned idling speed control. In FIGS. 11 and 12, line N corresponds to the N range condition in which $\Delta G_{FB}$ is determined from the characteristic of $\Delta G_{FBN.OFF}$ in FIG. 7. Line D.1 corresponds to the D range condition in which $\Delta G_{FB}$ is determined from the characteristic of $\Delta G_{FBN.OFF}$. Line D.2 corresponds to the D range condition in which $\Delta G_{FB}$ is determined from the characteristic of $\Delta G_{FBD}$. As apparent from the difference between line D 1 and line D 2, if $\Delta G_{FB}$ in the D range condition is determined by $\Delta G_{FBN.OFF}$, $G_{FB}$ changes steeply and engine speed falls unnecessarily because of larger additional feedback control intake air amount. If $\Delta G_{FB}$ in the D range condition determined by $\Delta G_{FBD}$, $G_{FB}$ changes gently enough to prevent engine speed from fluctuating.

Figure 13:
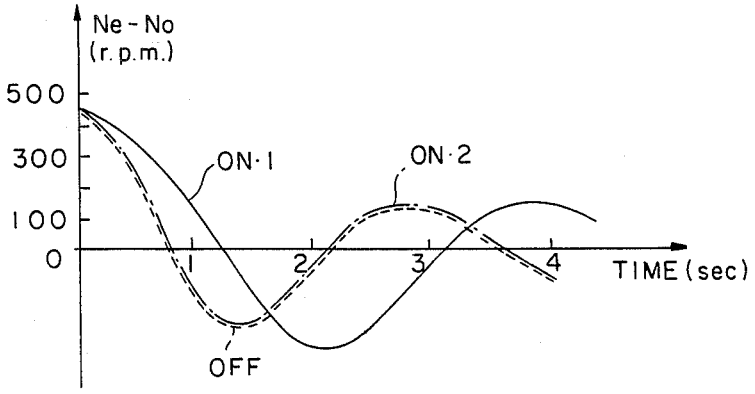
FIG. 13 is a graph illustrating the relationship between actual rotation speed and time, while an air conditioner is turned on according to the present embodiment.
Figure 14:
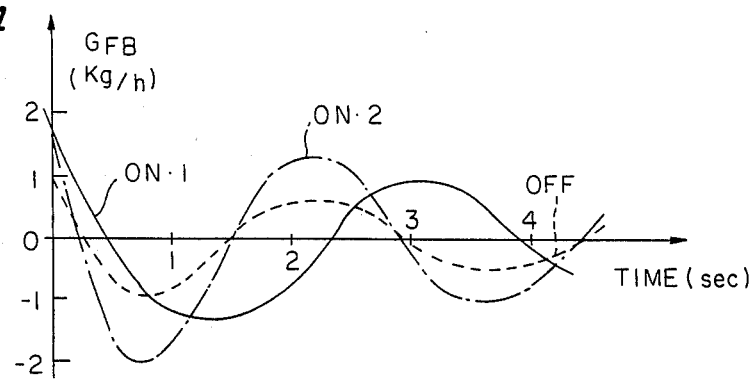
FIG. 14 is a graph illustrating the relationship between an actual additional intake air amount and the time which is the same as that in FIG. 13 according to the embodiment.

Referring to FIGS. 13 and 14, the graphs illustrate the changes of Ne-No and $G_{FB}$ when the cooling water temperature is above 80° C. Line OFF corresponds to the condition that the air conditioner A is in the non-operation condition in which $\Delta G_{FB}$ is determined from the characteristic of $\Delta G_{FBN.OFF}$ in FIG. 8. Line ON.1 corresponds to the condition that the air conditioner A is in the operation condition in which $\Delta G_{FB}$ is determined from the characteristic of $\Delta G_{FBN.OFF}$. Line ON.2 corresponds to the condition that air conditioner A is in the operation condition in which $\Delta G_{FB}$ is determined from the characteristic of $\Delta G_{FBN.ON}$.

In such a case that the air conditioner A is in the operation condition, target engine idling speed become larger. Therefore, the additional feedback control air amount $\Delta G_{FB}$ desirably ought to be larger compared to the condition that the air conditioner A is in the non-operation condition, as well as, to be large enough for the engine speed to meet quickly the target engine idling speed. As apparent from the difference between line ON.1 and line ON.2, if $\Delta G_{FB}$ is sufficiently large, the engine speed meets the target engine idling speed as quickly as line OFF.

Figure 15:
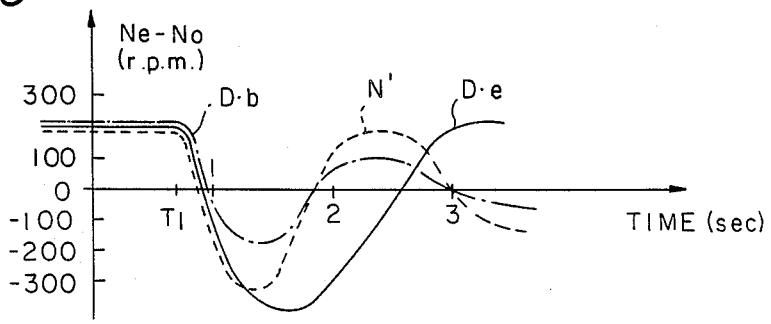
FIG. 15 is a graph illustrating the relationship between actual rotational speed and time, while an automatic transmission is selected to a drive range according to an alternative.
Figure 16:
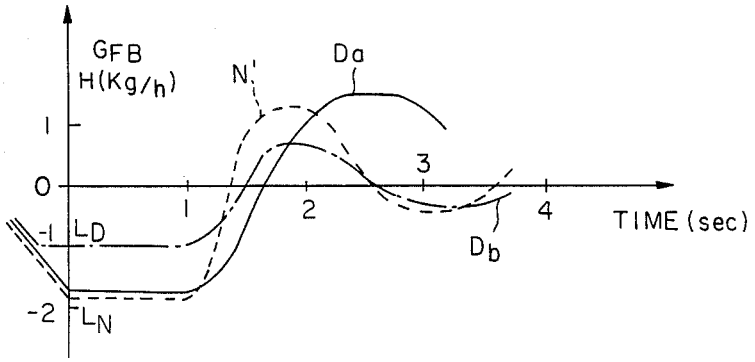
FIG. 16 is a graph illustrating the relationship between an actual additional intake air amount and the time which is the same as that in FIG. 15.

FIGS. 15 and 16 show the changes of Ne-No and $G_{FB}$ after the engine speed is kept a predetermined amount larger than the target engine idling speed. Line N corresponds to the N range condition in which the lower limit of $G_{FB}$ is set at $L_N$. Line D a corresponds to the D range condition in which lower limit of $G_{FB}$ is set at $L_N$. Line D a corresponds to the D range condition in which lower limit of $G_{FB}$ is set at $L_N$.

Such a condition occurs when throttle opening is increased within a detection range of TVO=0, or when the vehicle creeps under the idling condition. Time $T_1$ denotes the timing that the throttle opening is decreased or the vehicle stops. After the time $T_1$ though the engine speed falls, in case of line D·b the actual engine speed approaches quickly to the target engine idling speed.

Figure 17:
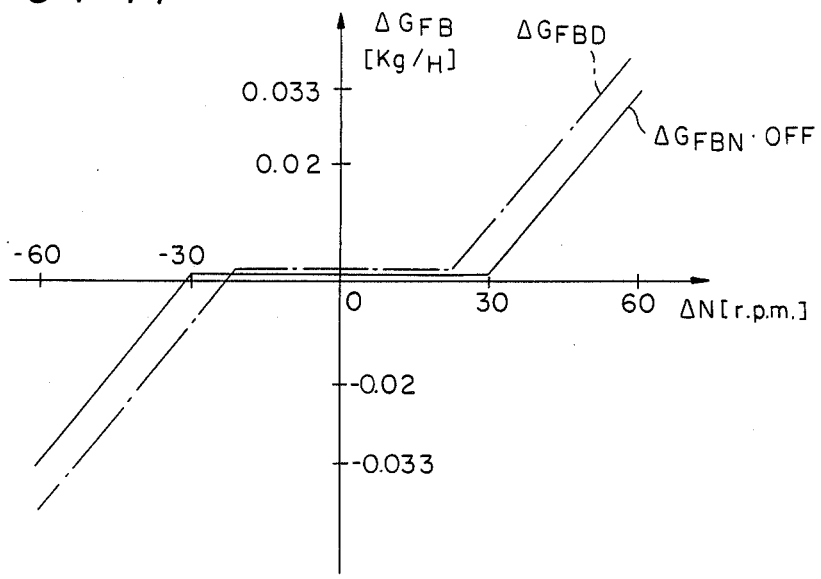
FIG. 17 is a diagram which is able to be used as an alternative instead of FIG. 7.
Figure 18:
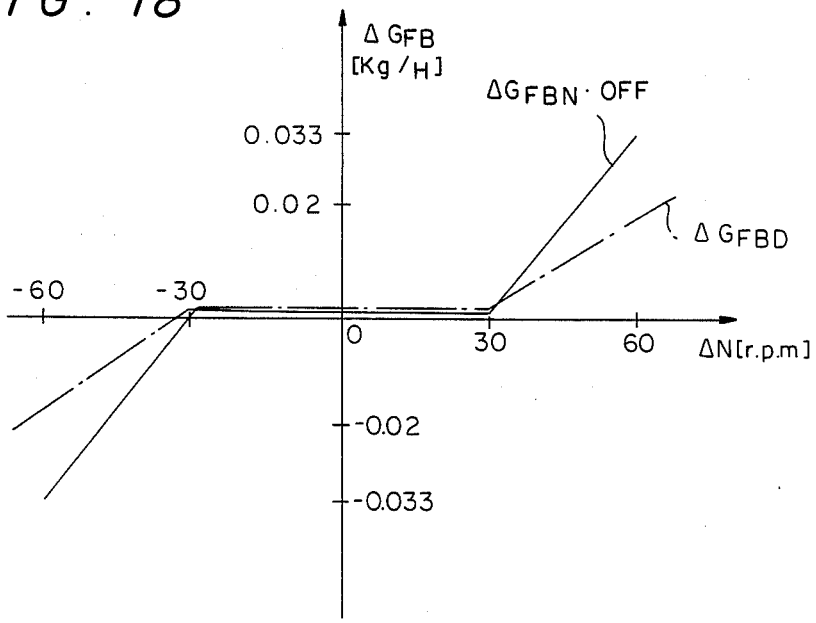
FIG. 18 is a diagram which is able to be used as an alternative instead of FIG. 7.

In the present embodiment, the characteristics of the additional feedback control air amount $\Delta G_{FB}$ are determined according to FIGS. 7 and 10. However, as an alternative, the characteristics can be determined according to FIG. 17 substitution for FIG. 7, when the engine speed change is sufficiently quick after the idling speed control in the D range condition. As a further alternative, FIG. 18 can be substituted for FIG. 7, when the target engine speed in the D range condition is much lower than that in the N range condition. Also, the idling speed control by controlling the ignition timing is able to be used instead of the idling speed control by controlling the intake air amount. In such a case, $\Delta G_{FB}$ in FIGS. 7 or 10 is substituted by advance crank angle of ignition timing.

In the above description of a preferred embodiment, the load of the automatic transmission or the air conditioner is applied for the external load. The load of a generator is able to be applied for the external load additionally.

Changes and modifications are possible without departing from the inventive teachings. Such are deemed to come within the purview of the claimed invention.

What is claimed:

1. A system for controlling idling speed of an internal combustion engine, comprising;

speed sensing means for sensing rotational speed of the engine;

determination means for determining whether the engine is in an idling state;

output adjusting means for adjusting engine output when the engine is determined to be in the idling state by said determination means;

memory means for storing a control variable of said output adjusting means in the form of a characteristic in which engine output rises approximately in proportion to a difference between a predetermined target idling speed and an actual idling speed with engine speed serving as a parameter;

control means responsive to outputs from said determination means and said speed sensing means for obtaining from said memory means a control variable corresponding to engine speed at idling, and for controlling said output adjusting means on the basis of said control variable;

load detecting means for detecting whether an external load is connected with the engine in operational relation; and control variable characteristic changing means for changing characteristic of said control variable from said memory means responsive to output from said load detecting means.

2. The system according to claim 1, wherein said memory means stores a control variable of said output adjusting means in the form of a characteristic, in which engine output is unchanged while the difference between the predetermined target idling speed and an actual idling speed is within a predetermined range.

3. The system according to claim 2, wherein said control variable characteristic changing means comprise changing means for selecting two types of predetermined ranges within which the engine output is unchanged, and the changing means selects wider type of predetermined range when said load detecting means detects an external load is connected with the engine in operational relations.

4. The system according to claim 2, wherein said control variable characteristic changing means comprise changing means for selecting two types of predetermined increasing rate of engine output, and the changing means selects a type of predetermined smaller increasing rate of engine output out of said predetermined range when said load detecting means detects an external load is connected with the engine in operational relation.

5. The system according to claim 2, wherein the system comprises target idling speed changing means for making target idling speed higher when said load detecting means detects an external load connected with the engine in operational relation, and said control variable characteristic changing means comprises changing means for selecting two types of predetermined increasing rate of engine output, and the changing means selects a type of predetermined larger increasing rate of engine output out of said predetermined range when said load detecting means detects an external load connected with the engine in operational relation.

6. The system according to claim 5, wherein said load detecting means detects whether an air conditioner is turned on.

7. The system according to claim 1, wherein said output adjusting means comprise a bypass passageway for bypassing a throttle, and said memory means stores a control variable of said bypass passageway.

8. The system according to claim 7, wherein said memory means stores a control variable of said output adjusting means in the form of a characteristic, in which additional engine intake air amount is zero while the difference between the predetermined target idling speed and an actual idling speed is within a predetermined range, additional engine intake air amount is minus while the actual idling speed is substantially higher than the predetermined target idling speed, and additional engine intake air amount is plus while the actual idling speed is substantially lower than the predetermined target idling speed, and the output adjusting means controls engine intake air by an accumulation of said additional engine intake air amount.

9. A system for controlling idling speed of an internal combustion engine, comprising;

an automatic transmission connected with the engine output shaft;

speed sensing means for sensing rotational speed of the engine;

determination means for determining whether the engine is in an idling state;

intake air amount adjusting means for adjusting engine intake air amount when the engine is determined to be in the idling state by said determination means;

memory means for storing a control variable of said intake air amount adjusting means in the form of a characteristic in which additional engine intake air amount rises approximately in proportion to a difference between a predetermined target idling speed and an actual idling speed with engine speed serving as a parameter;

control means responsive to outputs from said determination means and said speed sensing means for obtaining from said memory means a control variable corresponding to engine speed at idling, and for controlling said intake air amount adjusting means on the basis of said control variable;

transmission detecting means for detecting whether said automatic transmission is selected a drive range or whether it is selected a neutral range; and control variable characteristic changing means for changing characteristic of said control variable obtained from said memory means responsive to output from said transmission detecting means.

10. The system according to claim 9, wherein said control means comprises limit means for limiting engine intake air amount if larger than a predetermined lower limit, and said control variable characteristic changing means comprises changing means for changing said lower limit to a higher value when said transmission detecting means detects that the automatic detecting means detects that the automatic transmission is selected a drive range.

11. The system according to claim 9, wherein said control variable characteristic changing means comprises changing means for selecting two types of predetermined increasing rate of additional engine intake air amount, and the changing means selects a type of predetermined smaller increasing rate of additional engine intake air amount when said transmission detecting means detects the automatic transmission is selected a drive range.

* * * * *